United States Patent [19]

Kawakubo et al.

[11] Patent Number: 4,916,292

[45] Date of Patent: Apr. 10, 1990

[54] COILED RESISTANCE HEATING ELEMENT OF CARBONACEOUS MATERIAL

[75] Inventors: Takamasa Kawakubo, Gunma; Mitsuru Yoshida, Fujioka; Yoshihisa Suda, Maebashi, all of Japan

[73] Assignee: Mitsubishi Pencil Co., Ltd., Tokyo, Japan

[21] Appl. No.: 181,368

[22] Filed: Apr. 14, 1988

[51] Int. Cl.[4] ..... H05B 3/10

[52] U.S. Cl. ..... 219/553; 219/552; 338/267; 338/270

[58] Field of Search ..... 338/267, 263, 269, 270, 338/271, 66, 214; 219/552, 553; 313/336

[56] References Cited

U.S. PATENT DOCUMENTS

| | | | |
|---|---|---|---|
| 2,596,837 | 5/1952 | Calvert | 338/263 X |
| 3,928,659 | 12/1975 | Baxter | 219/271 X |
| 4,143,292 | 3/1979 | Hosoki et al. | 313/336 |

*Primary Examiner*—Bruce A. Reynolds
*Assistant Examiner*—M. M. Lateef
*Attorney, Agent, or Firm*—Oliff & Berridge

[57] ABSTRACT

A coiled resistance heating element of carbonaceous or graphite material is disclosed. A simplified process which includes carbonization or graphitization of a coiled strand of an organic material is also disclosed.

10 Claims, No Drawings

COILED RESISTANCE HEATING ELEMENT OF CARBONACEOUS MATERIAL

BACKGROUND OF THE INVENTION

The present invention relates to a coiled resistance heating element of carbonaceous material. The "carbonaceous" herein referred to is an adjective generically modifying amorphous carbonaceous substance as well as crystalline graphitic substances. Therefore, the "coiled resistance heating element of carbonaceous material" herein referred to includes both those heating elements showing properties peculiar to carbon which are substantially composed of carbon and those showing peculiar properties of graphite which are substantially composed of graphite.

In a non-oxidizing atmosphere, carbonaceous materials show excellent heat resistance and corrosion resistance without being melted nor deformed. Also they have a good electric conductivity close to metals. With these properties, the carbonaceous materials are useful for the manufacture of heating elements for high-temperature electric or resistance furnaces, and have been heretofore used for heaters of laboratory furnaces such as Tammann furnaces and kryptol furnaces. Recently, as the semiconductor industry develops, such high-temperature electric furnaces have come to be utilized increasingly extensively as production equipment.

As high-temperature furnaces, are also known combustion furnaces, electric arc furnaces, plasma furnaces and electron beam furnaces. However, resistance furnaces are superior to any of those high-temperature furnaces in respects of uniformity of temperature distribution, temperature control accuracy and facility of furnace atmosphere control as well as in the aspect of environmental protection such as noise or exhaust gas control.

Here, some advantageous features of the carbonaceous materials as used in the form of resistance heating elements will be reviewed briefly. The carbonaceous materials do not melt under normal pressures with their sublimation temperatures as high as about 3,650° C. and have extremely low vapor pressure in the order of 106 atm. at 2,200° C. They show a high resistance to corrosive gasses. Their emissivity is as high as about 0.8. Unlike metallic materials, the carbonaceous materials do not soften at elevated temperatures, but their strength increases with temperature up to 2,500° C. They have a moderate electric resistance. Especially, resistance of graphitic materials increases with temperature if exceeds about 500° C. With low coefficient of thermal expansion, the carbonaceous materials have a high thermal shock resistance. Very high purity may be attained and they emit only a limited quantity of gasses even under high vacuum. Further, the carbonaceous materials are substantially inexpensive as compared with other materials of heating elements such as platinum, rhodium, wolfram, molybdenum, tantalum and silicon carbide.

However, unlike metallic and plastic materials carbonaceous materials have very low malleability and are extremely hard to work with precision to desired shapes. Therefore, in a known process for manufacturing heating elements, the carbonaceous materials are first molded into large-sized blocks and pieces cut out therefrom are subjected to cutting using a numerically controlled lathe or the like involving difficult and complicated operations. Especially, in tubular or planar heating elements of carbonaceous materials, notches are cut, for example, spirally or longitudinally to increase electric resistance, or they are worked otherwise specially. However, despite of such contrivance, the conventional heating elements of carbonaceous materials are not satisfactory in many respects. Not only difficulties are encountered in their working, but also they are massive. Since mechanical strength is decreased at notched portions, their structures, especially of those portions connecting terminals, require special consideration in design to prevent application thereto of bending, tensile and the like stresses caused by thermal expansion and contraction. Further, special care must be paid to handling of such heating elements of the prior art.

More recently, use of clothes or cords made of carbon fibers as heating elements having flexibility has been proposed. The flexibility permits such heating elements to be wound around furnace bodies and therefore inconveniences or disadvantages of the preceding heating elements of carbonaceous materials can be compensated for to some extent. However, since clothes or cords of carbon fiber have only a poor elasticity by nature, special retaining means must be provided to secure close contact onto furnace bodies. If such heating elements are bound tightly on a furnace to improve the closeness of contact, their durability will be decreased under stresses caused in use by thermal expansion and contraction. Further, the expense of carbon fibers adds to the costs of clothes or cords made thereof.

In respects of close contact on furnace bodies, relief of internal stresses of heating elements, ease of handling and mounting, conventional coiled heating elements of metal wires are desirable because they have a suitable elasticity and flexibility. However, it will be furthermore advantageous and desirable if coiled resistance heating elements of carbonaceous materials are developed. Nevertheless, such coiled heating elements of carbonaceous materials having a high strength have not been manufacturable by cutting of molded carbon blocks as prevalent in the prior art, so long as at least commercial-scale production is concerned.

SUMMARY OF THE INVENTION

Accordingly, an object of the present invention is to provide coiled resistance heating elements of carbonaceous materials which have not been manufacturable by the prior art.

More specifically, in the utilization of excellent heat resistance, corrosion resistance, emissive power, high mechanical strength, adequate electric conductivity and high thermal shock resistance, the present invention provides coiled heating elements of carbonaceous or graphitic materials which can be produced easily with high precision to desired sizes and shapes. According to the present invention, the heating elements of such carbonaceous materials can be produced by first coiling a strand of an organic material or a strand of a composite organic material reinforced by carbon fibers, graphite whiskers, crystalline graphite powder or amorphous carbon powder and then heating the coiled strand in an inert gas atmosphere. As required, the coiled strand is subjected to a treatment for producing a carbon precursor before said heating step.

The coiled resistance heating elements of the present invention can be manufactured to a very high precision without post-working or secondary working and have excellent heat resistance, corrosion resistance, emissive power, high mechanical strength, adequate electric conductivity and high thermal shock resistance. Also, they show a high elastic modulus with highly reliable accuracy. With light weight and adequate flexibility, the coiled heating elements according to the present invention can be closely fitted onto an electric furnace body. since the elasticity of the coil structure absorbs internal stresses caused by thermal expansion and contraction, no special contrivances are required for method of fitting onto the furnace body or in the design of the section involving terminals.

According to the present invention, the strand of organic material can be obtained by molding into a strand shape an organic polymer, asphalt pitch, dry-distilled pitch or other pitches or a mixture of two or more of them. While, the strand of composite organic material according to the present invention can be produced by first homogeneously dispersing at least one component to be selected out of the group of carbon fibers, graphite whiskers, crystalline graphite powder and amorphous carbon powder in the aforesaid organic polymer, asphalt pitch, dry-distilled pitch or other pitches or a mixture or two or more of them and then molding the dispersion into a strand shape while subjecting the same to a high orientation.

According to the present invention, the strands may have any diameters up to the order of several millimeters.

The organic polymers usable according to the present invention include thermoplastic resins such as polyvinyl chloride, polyacrylonitrile, polyvinyl alcohol, vinyl chloride/vinyl acetate copolymer, polyamides and polyimides; thermosetting resins such as phenolic resins, furan resins, epoxy resins and unsaturated polyester resins; those natural polymers having condensed aromatic rings in their basic molecular structures such as lignin, cellulose, tragacanth gum, arabic gum and polysaccharides; and synthetic polymers having condensed aromatic rings in their basic molecular structures but not covered by the just preceding polymers, such as formalin condensate of naphthalenesulfonic acid, indanthrene-type vat dyes and intermediates thereof.

The pitches usable for the present invention included petroleum asphalt pitch, coal-tar pitch and cracked naphtha pitch as well as dry-distilled products of such petroleum asphalt pitch, coal-tar pitch or hydrocarbon resins having a boiling point of about 400° C. or below.

Some of the aforementioned materials may have very poor moldability or formability cannot be ideally carbonized if they are used individually. However, such materials having poor moldability or formability may be used as being blended with one or more of the aforementioned thermoplastic resins as a binder. While, those materials incapable of undergoing ideal carbonization may readily form carbon precursors by being mixed with other compounds in the presence of carbonizing catalysts typically represented by oxides of iron, nickel and cobalt or Lewis acid such as aluminum chloride and then heated for dehydrogenation.

As to the aforementioned composite organic materials reinforced by carbon fibers, graphite whiskers, crystalline graphite powder or amorphous carbon powder, the present invention requires that the composition for the strand reinforced thereby contain about 20 to about 80 percent or, more preferably, about 40 to about 70 percent by weight of such a reinforcing material, although the optimum reinforcing material content varies with the type of matrix material used and the diameter of the intended strand.

One or more of the aforementioned reinforcing materials may be selectively used in the foregoing range as most suitable to the diameter, mechanical strength, elastic modulus, thermal shock resistance, electric conductivity and cost aspect specifically intended for each coiled heating element product.

According to the present invention, the strand of organic material may be produced by directly melting at least one substance to be selected from the group of natural and synthetic organic polymers including thermoplastic and synthetic resins and pitches or, as required, by homogeneously dispersing such a material in a solvent in the presence of a plasticizer, carbonizing catalyst, crosslinking agent and/or polymerization initiator, then pelletizing the molten material or dispersion and extruding the pellet through an extruder to into a strand of a desired diameter.

To obtain an organic strand of composite organic material, one or more of carbon fibers, graphite whiskers, crystalline graphite powder or amorphous carbon powder may be added to the aforementioned substance.

For mixing a composition containing two or more material substances or at least one reinforcing material, the composition may be first dispersed by using a high-speed blender, for example, and then kneaded for homogenization by means of a kneading means such as a pressure kneader, twin roll and co-kneader which can exert a high shear to the composition.

In the extrusion step, it is desired that the extrudate be subjected to an appropriate orientation to improve the properties of the resultant strand.

To form the thus prepared strand into a coil shape, the strand is coiled around a round or polygonal rod or pipe of a desired size having smooth surfaces made of a heat-resistant material which can withstand 1,000° C. or higher temperatures, and the opposite ends are fixed.

Then, for carbonizing or graphitizing the coiled strand, the organic or composite organic material of the strand is first insolubilized and infusibilized to be turned into a carbon precursor by adding thereto a carbonizing catalyst, crosslinking agent and/or polymerization initiator or by treating it with an acid. Alternatively, it may be crosslinked by heating at about 50° C. to about 300° C. in an atmosphere of chlorine gas, ozone or heated air, or it may be crosslinked and cured b irradiating the same with ultraviolet rays, electron rays or radiation.

The coiled strand substantially comprising a carbon precursor is heated as wound up on the rod or pipe in an inactive atmosphere such as nitrogen or argon gas by gradually increasing the temperature. The temperature is increased up to about 500° C. to 1,500° C. or, more preferably, to about 1,000° C. o 1,500° C. when it is desired to produce a coiled resistance heating element of carbonaceous material. While, for obtaining a coiled resistance heating element of graphitic material, the temperature is gradually increased up to about 2,000° C. to 3,000° C. or, more preferably, to about 2,500° C. to 3,000° C.

DETAILED DESCRIPTION OF THE PREFERRED EMBODIMENTS

EXAMPLE 1

A mixture of hundred parts by weight of a straight polyvinyl chloride resin with average polymerization degree of 700 and 30 parts by weight of dioctyl phthalate is homogeneously dispersed by using a Henschel mixer. Then the dispersed stock as kept at about 150° C. is fully kneaded in a pressure kneader.

the thus kneaded material is then pelletized by means of a pelletizer, and the resultant pellet is extruded through a screw extruder into a long polyvinyl chloride strand of 0.8 mm in diameter. The strand is coiled around a bobbin of a carbonaceous material having outside diameter of 10.0 mm and heated in air at 100° C. for 10 hours first, and then at 180° C. for 24 hours to turn the strand material into an insoluble and infusible carbon precursor. Then, in a nitrogen gas atmosphere, the coiled strand thus treated is gradually heated up to 500° C. by raising the temperature at a rate of 10° C./hr, and then up to 1,000° C. by increasing the temperature at a rate of 50° C./hr. After keeping at his temperature for 3 hours, the coil is left as it cools naturally down to room temperatures.

The coil is released from the bobbin. Consequently, a coiled resistance heating element of carbonaceous material is obtained which is 0.4 mm in strand diameter, 10.0 mm in coil inside diameter and 500 mm in coil length.

EXAMPLE 2

A mixture of 100 parts by weight of a furan resin (a precondensate of furfuryl alcohol), 100 parts by weight of straight polyvinyl chloride resin with average polymerization degree of 700, 50 parts by weight of crystalline graphite powder with average particle size of 2.0 microns and 10 parts by weight of dioctyl phthalate as a plasticizer is homogeneously dispersed in a Henschel mixer. Then, the stock dispersion as kept at 140° C. s kneaded in a pressure kneader for 30 minutes to obtain a homogeneous composition.

The composition is then subjected to preforming using a vacuum preforming machine, and the preformed composition is extruded through a hydraulically-driven plunger extruder into a long strand of 1.0 mm in diameter.

Then, the strand is coiled around a round carbon bar of 15.0 mm in diameter with the opposite ends of the strand fixed.

The coiled strand is then placed in an oven having the atmosphere heated to 180° C. and kept therein for 24 hours until the furan resin is fully cured by hydrogen chloride produced by decomposition of polyvinyl chloride resin. As a result, the strand material is turned into an insoluble and infusible carbon precursor. Then, in a nitrogen gas atmosphere, the coiled strand thus treated is gradually heated up to 300° C. by raising the temperature at a rate of 10° C./hr., the last maximum temperature being maintained for further 3 hours. Thereafter, the coil is left as it cools naturally down to room temperatures.

Then the coil is released from the carbon bar. Consequently, a coiled resistance heating element of carbonaceous material is obtained which is 0.75 mm in strand diameter, 15.0 mm in inside diameter and 500 mm in length.

EXAMPLE 3

For graphitizing the coil material, the coiled heating element obtained in Example 1 as would on the bobbin is further subjected to heat treatment in an argon gas atmosphere by raising the temperature up to 1,000° C. at a rate of 300° C./hr. first and then up to 2,800° C. at a rate of 400° C./hr. After keeping at this temperature for 60 minutes, the coil is left as it cools naturally down to room temperatures. When the coiled is released from the bobbin, a coiled resistance heating element of graphitic material having the same size and shape as that of Example 1 is obtained.

What is claimed is:

1. A coiled resistance heating element of carbonaceous material substantially composed of carbon and having properties peculiar to carbon, produced by carbonization of a coiled strand of a composite a organic material wherein said organic material is selected from the group consisting of asphalt pitches, dry-distilled pitches, and organic polymers selected from the group consisting of polyvinyl chloride, polyvinyl alcohol, vinyl chloride/vinyl acetate copolymers, polyamides, polyimides, phenolic resins, furan resins, epoxy resins, unsaturated polyester resins, lignin, cellulose, tragacanth gum, arabic gum, polysaccharides, formalin condensates of napthalenesulfonic acid, and indanthrene-type vat dyes, and mixtures thereof.

2. The heating element of claim 1 wherein said composite organic material comprises an organic material reinforced by a reinforcing member selected from the group consisting of carbon fibers, graphite whiskers, crystalline graphite powder and amorphous graphite powder.

3. The heating element of claim 1 wherein said asphalt pitches are selected from the group consisting of petroleum asphalt pitch, coal tar pitch and cracked naptha pitch.

4. The heating element of claim 1 wherein said dry-distilled pitches have a maximum boiling point of about 400° C.

5. The heating element of claim 2 wherein said composite organic material contains from 20 to 80 percent by weight of said reinforcing member.

6. The heating element of claim 5 wherein said composite organic material contains from 40 to 70 percent by weight of said reinforcing member.

7. The heating element of claim 2 wherein said organic composite material is prepared by dispersing said reinforcing member throughout said organic material using a high speed blender.

8. The heating element of claim 2 wherein said carbonization is performed by first insolubilizing or infusibilizing said coiled strand and then heating said coiled strand to at least 500° C. in an inert atmosphere.

9. The heating element of claim 8 wherein said coiled strand is heated to a temperature in the range of 1,000° to 1,500° C.

10. The heating element of claim 8 wherein said coiled strand is heated to a temperature in the range of 2,000° to 3,000° C.

* * * * *